United States Patent [19]

Kornelis

[11] 4,244,481

[45] Jan. 13, 1981

[54] CLOSURE CAP WITH SEALING RING

[75] Inventor: Wiebren D. H. Kornelis, Steenwijkerwold, Netherlands

[73] Assignee: Kornelis' Kunsthars Producten Industrie BV, Steenwijk, Netherlands

[21] Appl. No.: 60,060

[22] Filed: Jul. 24, 1979

Related U.S. Application Data

[63] Continuation-in-part of Ser. No. 878,338, Feb. 23, 1977, abandoned.

[30] Foreign Application Priority Data

Jul. 25, 1978 [NL] Netherlands ..... 7807901

[51] Int. Cl.[3] ..... B65D 53/06

[52] U.S. Cl. ..... 215/348

[58] Field of Search ..... 215/260, 270, 329, 341, 215/348, 352

[56] References Cited

U.S. PATENT DOCUMENTS

| | | | |
|---|---|---|---|
| 2,339,702 | 1/1944 | Isele | 215/329 |
| 3,144,154 | 8/1964 | Puse | 215/260 |
| 3,169,656 | 2/1965 | Weickmann | 215/329 |
| 3,428,202 | 2/1969 | Asmus | 215/270 |
| 3,435,976 | 4/1969 | Owens | 215/329 |
| 4,051,972 | 10/1977 | Botkin | 215/260 |

FOREIGN PATENT DOCUMENTS

| | | | |
|---|---|---|---|
| 544117 | 7/1957 | Canada | 215/348 |
| 2806267 | 8/1978 | Fed. Rep. of Germany | 215/341 |
| 984146 | 2/1951 | France | 215/341 |

*Primary Examiner*—Donald F. Norton

*Attorney, Agent, or Firm*—Scully, Scott, Murphy & Presser

[57] ABSTRACT

An internally rotation-symmetrical closure cap for closing a container, comprising a closed end wall and a side wall, said end wall being internally provided with an integral annular channel provided with a sealing ring in co-operation with the upper rim of the container by means of which the container is sealed. The channel comprises side walls which have the shape of two facing undercuts, while the sealing ring is a ring formed in situ by gelation.

7 Claims, 3 Drawing Figures

CLOSURE CAP WITH SEALING RING

This application is a continuation-in-part of application Ser. No. 878,338, filed Feb. 23, 1977 and now abandoned.

The invention relates to an at least internal rotation-symmetrical closure cap made of a thermoplastic polyolefin material for closing a container comprising a rotation-symmetrical neck portion, which closure cap comprises a closed end wall and a side wall, the wall portion being internally provided with means through which the closure cap can be connected to the neck portion of the container with closure thereof and substantially the end wall being internally provided with a channel-like circular-symmetrical seat portion integral therewith, whereby at least one wall of the channel is formed by a collar projecting from the end wall while the channel is provided with a sealing ring of a depressable synthetic material sealing the container in cooperation with the rim of the neck portion.

Such a closure cap is known from German Offenlegungsschrift No. 2,530,755. The prior art closure cap may be made of a polypropylene material and the sealing ring of a PVC-material or likewise of a small-pore foam material. The channel-like seat portion of the closure cap has straight walls, whereby adjacent the wall formed by the collar projecting from the end face, the wall portion of the closure cap itself is utilized for forming the other wall of the channel. The sealing ring available in the channel is a pre-formed ring which consequently is installed in the channel in ready condition. Since a thermoplastic material, such as polypropylene, moreover is a material by means of which no adhesive joint can be realized, the sealing ring can only be loosely inserted. If such a closure cap would be used in those cases wherein the filled container is used longer in the sense that thereby the closure cap is frequently opened and closed, the sealing ring will not be maintained in the channel. But also already in the phase which preceeds the factory-filling of the containers in e.g. the food industry, maintenance of the sealing ring in the channel of the closure cap will be difficult. For mostly a large quantity of closure caps is stored in a tipping container, whereby the tipping movement ensures that the closure caps are transported one after the other to the discharge portion of the tipping container and hence to the containers to be closed. The forces occurring during the tipping movement, but also the chance that a certain cover for statistic reasons may have a residence time in the tipping container that is much longer than the conventional residence time, sets high requirements to the maintainability of the sealing ring. This maintainability should be basically absolute with a view to an undisturbed operation.

It is the object of the present invention to provide a closure cap provided with a sealing ring of the above described type, whereby, irrespective of the fact that it is not possible to use an adhesive joint between the sealing ring and the closure cap in the channel thereof, nevertheless the maintenance of the sealing ring in the channel is ensured as well as the sealing of the contents of the container to be achieved thereby, also in those cases that the contents of the container is an aggressive material to a certain extent (e.g. in case of containers containing pickled gherkins, Bismarck herring etc), and furthermore irrespective of the usual operations to which the materials introduced in the container are subjected before or after the closure of the container, e.g. pasteurization.

According to the invention a closure cap is provided which complies with the above mentioned conditions and which is characterized in that the two walls of the channel have the shape of two facing undercuts and that the sealing ring is a ring formed in situ in the channel by gelation.

The invention is based on the insight to use the closure cap itself, i.e. the channel disposed therein, as the form by means of which the sealing ring is manufactured. As a result it is possible to realize an optimally form-fitting connection of the formed ring onto the walls and bottom of the channel. In combination with the channel-form prescribed according to the invention, which is such that the channel walls are formed as two facing undercuts, it appears that there is thus obtained a closure cap which complies with the above mentioned conditions.

As material for manufacturing the sealing ring may be suitably used commercially available "puff" or "compound" material, being products to be gelated at increased temperature. These comprise products the gelling component of which is based on a polyvinylchloride material. In a mixture processed to a plastisol with conventional components, e.g. foaming agents, catalysts, softening agents, pigments and stabilizing agents, these products, after gelation at increased temperature, result in a slightly foamed sealing ring.

Examples of raw materials for preparation of mixtures to be gelled in situ in the channel-like seat portion to a sealing ring, as regards the polyvinylchloride component, are the products that are commercially available under the name of Vinnol, e.g. those with the type indications E/68 CP, E10/65C, E78/CT, P70E, respetively C11 (Wacker Chemie); Hostalit with the type indication PVP 3475 (Hoechst); Solvic with the type indications 367NC, P 368/67A, 374MB, respectively 258 RD (Solvay). Examples of suitable stabilizers are Stanclere T 5500 (Akzo Chemie), Irgastab with the type indications CZ 111, CZ 97, Z 18 (Ciba Geigy); Lankromark DP 5736 respectively LN 358 and Vastablit A. As softening agents may be cited for instance Santicizer 160 B.B.P., dioctylphthalate, tinoctylphosphate or the products marketed by Bayer Mesamoll and Lipimol O., hexyleneglycol, butylglycol and butylstearate are examples of adequate viscosity controlling agents, while as foaming agents may be cited for instance Porofor with type indications ADC-M, D 33 and DNO/F (Bayer); Genitron AC4 (Fisons) and urea. By a suitable choice among the raw materials, it is possible to arrive at a sealing ring gelated in situ in the channel, which at a practically complete maintainability thereof in the channel-like seat portion, is constructed indeed for the subsequent application purpose of the closure cap.

The mixture from which the sealing ring is formed in situ in the channel provided in the closure cap is supplied in liquid condition in a predetermined quantity depending on the eventual degree of filling to be obtained of the channel. For the purpose of a uniform distribution of the mixture in the channel, the closure cap is adapted for rotation in the horizontal plane. Naturally allowance should be made during the gelation conditions for the fact that the closure caps are made of a thermoplastic polyolefin material. Upon application of a closure cap of a polypropylene quality which is not heat-resistant, it is to be preferred in particular to perform the gelation at a temperature of at most approximately 180° C. during a period of time not exceeding approximately 3 minutes.

Furthermore it is also possible to gelate the mixture of the sealing ring by a high frequency generator in situ in the channel of the closure cap. This has the advantage that the temperature of the closure cap does not rise, at least to a slight extent, so that the wall thicknesses of the closure cap which upon normal heating through heat supply are partly determined with a view to maintaining the temperature of the closure cap below a specific value so as to prevent deformation thereof, can be chosen thinner.

One embodiment of the closure cap according to the invention will now be explained, by way of example, with reference to the accompanying drawing, wherein.

The closure cap has the practically frequently found shape of a hollow cylinder closed at one leading end with a substantial width/height ratio, the wall at the exterior being provided for a better grip with knurls 6.

Figure 1:
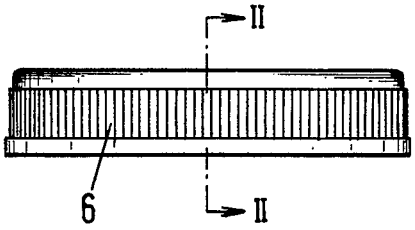
FIG. 1 shows a side view of the closure cap.
Figure 2:
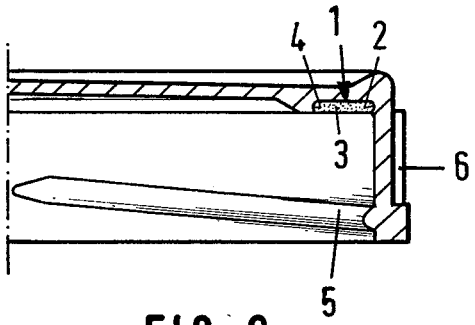
FIG. 2 is a cross-section of the closure cap on the line II—II in FIG. 1.
Figure 3:
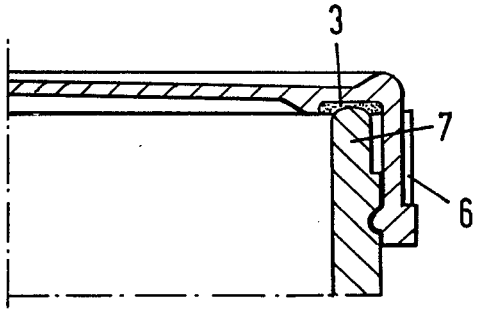
FIG. 3 is a cross-section of the neck portion of a container closed by the closure cap.

In the seat portion the channel is represented by 1 having walls in the form of two facing undercuts, represented by 2 and 4. By 5 is shown a member through which in combination with other similar members, not shown, in the wall of the cap in co-operation with correspondingly formed members at the exterior of the cylindrical neck portion 7 of the associated container (FIG. 3), the cap can be tightened thereon by means of helical motion. To this effect the dimensioning of the cap and of the neck portion of the container are so matched that in closed position the upper edge of the neck portion of the container abuts against the sealing ring 3 to be disposed in the channel 1, depressing same, while furthermore the width of the entrance opening to the channel is sufficiently larger than the thickness of the edge of the neck 7, in such a way that the two undercut channel walls release the neck rim on either side. Thus the sealing of the container achieved by the closure cap is exclusively determined by the sealing of the sealing ring gelated in situ on the upper rim of the neck. Not only has it been experimentally established that during the frequent opening and closure of the closure cap, upon use in practice, also in those case when the contents of the container are a material having a high sugar content, e.g. honey, and as a result highly adhesive, the sealing ring in the channel is maintained in place but moreover it appears that a thus designed closure cap the sealing of which is not affected by contact of one or both channel walls with the neck of the container, has particular closing properties which will be elucidated later on.

Preferably the undercuts are formed in mirror-symmetrical relationship, but this is not necessary. For instance the undercut 4 may be higher than the undercut 2. After gelation of the sealing material disposed in the channel, the undercut 2 will then have penetrated all around in the circumferential plane of the sealing ring, so that an additional anchoring effect for the ring is achieved.

The necessity to design two walls of the channel in the form of two undercuts also becomes apparent from the fact that if by closing the closure cap with large closing pressure, the gelated sealing ring is cut via the top of the neck rim, the two resulting concentric sealing ring portions, after the loosening of the closure cap, spontaneously fall out of the channel. The function of the undercut channel walls is the more surprising when it is considered that the maintenance of the sealing ring in the channel is already ensured at a height of the channel walls of e.g. approximately 0.8 mm at an average channel width of approximately 6.5 mm.

The closure cap according to the invention is excellently usable in the food sector, e.g. for closing glass containers filled with pickled gherkins or onions. Foodstuffs are often perishable goods the preservability of which in the container is increased if a reduced pressure is maintained therein.

For determining the duration of the sealing properties of a closure cap according to the invention, experiments have been made with different types of foodstuffs, during which always a glass wide-mouthed container was filled in cold condition together with the foodstuffs, e.g. pickled gherkins, while the free space remaining above the contents in the container was treated with a jet of saturated steam having a temperature of about 105° C., after which the container was closed by the closure cap. After cooling of the steam-heated contents, the pressure in the container relative to the atmospheric pressure had been reduced by 20–35 cm Hg. Subsequently the closed container was conducted through a pasteurization apparatus and maintained therein for 40–45 minutes at a temperature of 85° C. The pressure increasing again under influence of the temperature increase in the container, when reaching a pressure partly determined by the flexibility of the employed closure cap, was found to result in that the sealing ring was shortly lifted from the neck rim and thus offering an opportunity of ventilating gaseous and vaporous material available in the container towards the surroundings until again pressure equilibrium was attained, etc. After cooling subsequent to the effected pasteurization treatment, the pressure in the container relative to the atmospheric pressure was found to have been reduced by about 35 cm Hg. This reduced pressure, in duration experiments which were terminated after 3 months, could be maintained conveniently, irrespective of the fact consequently that during the ventilation the relation between sealing ring and neck rim was broken.

The capacity of the closure cap according to the invention to ventilation without damage to the sealing properties thereof, offers the possibility to likewise impart to the closure cap the function of safety valve. To this end the flexibility of the closure cap is pre-set at a specific ventilation pressure. Upon application of such a closure cap on a container having a breaking pressure that is substantially higher, and which contains chemicals that are dangerous when under pressure, e.g. chemicals which may lead to gas development under influence of a chemical reaction, or an aerated beverage, then, in case of undesirable pressure increase upon attainment of the ventilation pressure value set, the released gas will be ventilated outwardly, after which again a completely leak-tight closure is obtained.

What I claim is:

1. A closure cap at least circularly symmetrical internally, made of a thermoplastic polyolefin material for closing a container containing a circularly symmetrical neck portion, which closure cap comprises a closed end wall and a side wall, the side wall being internally provided with means through which the closure cap can be connected to the neck portion of the container with closure thereof and the end wall is internally provided with a channel-like circular-symmetrical seat portion integral therewith, at least one wall of the channel being formed by a collar projecting from the end wall, and the channel is provided with a sealing ring from a depressable synthetic material for sealing the container in cooperation with the upper rim of the neck portion, characterized in that both walls of the channel have the shape of two facing undercuts and the sealing ring is a ring formed by gelation in situ.

2. A closure cap according to claim 1, characterized in that said sealing ring has been gelated at increased temperature by heating.

3. A closure cap according to claim 1, characterized in that the sealing ring has been gelated by means of a high frequency generator.

4. A closure cap according to claim 1, characterized in that the walls of the channel are formed in mirror-symmetrical relationship.

5. An assembly comprising a container and a closure cap according to claim 1 or 2 or 3 or 4.

6. An assembly according to claim 5, characterized in that the thermoplastic material from which the closure cap is made is less hard than of the neck portion of the container.

7. An assembly according to claim 5, characterized in that the width of the entrance opening to the channel is sufficiently larger than the thickness of the neck rim of the container for preventing in transverse direction connection of the channel walls to the neck rim.

* * * * *

REEXAMINATION CERTIFICATE (246th)

United States Patent [19] [11] B1 4,244,481

Kornelis [45] Certificate Issued Sep. 11, 1984

[54] CLOSURE CAP WITH SEALING RING

[75] Inventor: Wiebren D. H. Kornelis, Steenwijkerwold, Netherlands

[73] Assignee: Kornelis' Kunsthars Producten Industrie BV, Steenwijk, Netherlands

Reexamination Request:
No. 90/000,409, Jun. 20, 1983

Reexamination Certificate for:

| | |
|---|---|
| Patent No.: | **4,244,481** |
| Issued: | **Jan. 13, 1981** |
| Appl. No.: | **60,060** |
| Filed: | **Jul. 24, 1979** |

Related U.S. Application Data

[63] Continuation-in-part of Ser. No. 878,338, Feb. 23, 1977, abandoned.

[30] Foreign Application Priority Data

Jul. 25, 1978 [NL] Netherlands ..... 7807901

[51] Int. Cl.[3] ..... B65D 53/06
[52] U.S. Cl. ..... 215/348
[58] Field of Search ..... 215/348, 341

[56] References Cited

FOREIGN PATENT DOCUMENTS

| | | |
|---|---|---|
| 47374 | 1/1976 | Australia . |
| 1718460 | 12/1955 | Fed. Rep. of Germany . |
| 1184271 | 12/1964 | Fed. Rep. of Germany . |
| 464721 | 12/1968 | Switzerland . |
| 1327583 | 8/1973 | United Kingdom . |

OTHER PUBLICATIONS

*Modern Packaging*, vol. 43, No. 4 (Apr. 1970) pp. 124, 143; vol. 43, No. 10 (Oct. 1970) p. 8.
*Crowns, The Complete Story* (4th Edition) John J. Nurnberg, (1967), pp. 341 and 412–413.

*Primary Examiner*—Donald F. Norton

[57] ABSTRACT

An internally rotation-symmetrical closure cap for closing a container, comprising a closed end wall and a side wall, said end wall being internally provided with an integral annular channel provided with a sealing ring in co-operation with the upper rim of the container by means of which the container is sealed. The channel comprises side walls which have the shape of two facing undercuts, while the sealing ring is a ring formed in situ by gelation.

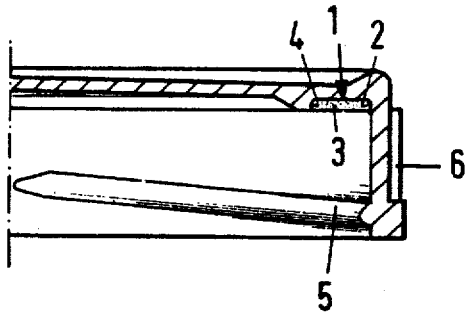

REEXAMINATION CERTIFICATE ISSUED UNDER 35 U.S.C. 307.

THE PATENT IS HEREBY AMENDED AS INDICATED BELOW.

AS A RESULT OF REEXAMINATION, IT HAS BEEN DETERMINED THAT:

Claims 1-7 are cancelled.

* * * * *